United States Patent [19]

Scholle

[11] 4,105,139

[45] Aug. 8, 1978

[54] SHELL FOR FLEXIBLE BAG HAVING MOUNTING FOR SPOUT

[75] Inventor: William R. Scholle, Corona Del Mar, Calif.

[73] Assignee: Scholle Corporation, Northlake, Ill.

[21] Appl. No.: 770,087

[22] Filed: Feb. 18, 1977

[51] Int. Cl.[2] ..... B65D 33/00; B65D 33/38

[52] U.S. Cl. ..... 222/105; 220/306; 222/183

[58] Field of Search ..... 217/76; 220/63, 265, 220/266, 306, 307; 222/105, 143, 183, 185, 146 C, 131; 206/306

[56] References Cited

U.S. PATENT DOCUMENTS

| | | | |
|---|---|---|---|
| 3,026,005 | 3/1962 | Cook | 222/105 |
| 3,363,807 | 1/1968 | Powell | 222/183 X |
| 3,453,033 | 7/1969 | Goss | 222/183 X |
| 3,599,840 | 8/1971 | Speas | 222/183 |
| 3,627,399 | 12/1971 | Addison et al. | 222/183 X |
| 3,696,969 | 10/1972 | DeVan et al. | 222/183 X |

*Primary Examiner*—Robert B. Reeves
*Assistant Examiner*—David A. Scherbel
*Attorney, Agent, or Firm*—Gary, Juettner & Pyle

[57] ABSTRACT

A fluent dispenser comprising an outer shell having one closed end and one open end, a fluent filled flexible plastic bag inserted in the shell through the open end thereof, and a generally planar closure or wall detachably mounted in the open end of the shell to retain the bag therein, the bag having a dispensing spout and the shell or closure having movable flaps facilitating extraction of the spout and mounting of the spout to provide for convenient dispensing of the fluent contents of the bag. In the preferred embodiment, the shell is an integral, semi-rigid, molded plastic member, and the closure is fiberboard. Also in the preferred embodiment, the shell is formed to simulate a barrel to complement the packaging and service of beverages such as wine. Other features include a removable bung in the shell for insertion between the shell and the bag of ice and/or water for chilling the bag contents; and the provision on the shell of a flattened side wall area to orient the spout downward and to prevent the shell from rolling when the barrel is placed on its side in fluent dispensing position. In one embodiment, the shell may be provided at its open end with an integral partial end wall section to facilitate rigid mounting of the dispensing spout, chilling of the bag contents with ice and ice water, and use of a fiber-board closure that would not be wetted by the ice water.

21 Claims, 6 Drawing Figures

SHELL FOR FLEXIBLE BAG HAVING MOUNTING FOR SPOUT

BACKGROUND OF THE INVENTION

The invention relates to dispensing containers, and in particular to a container comprising an outer shell which houses a flexible liquid or fluent filled bag.

Usually the shell is made of corrugated paper and is generally rectangular in shape. A few proposals have been made in the past to provide a rigid or semi-rigid molded outer shell, such for example as shown in U.S. Pat. Nos. 3,026,005, 3,212,681 and 3,448,897, but these have not replaced the cardboard shell or box as the standard of the industry.

While the prior art containers are functional, they lack aesthetic appeal, and there is lack of consumer acceptance for certain products, such as spirits, packaged in this manner; spirits being more traditionally packaged in bottles, kegs or small barrels. However, such traditionally shaped enclosures are not readily usable with a flexible liquid filled bag because, usually, there is only a small opening in the enclosure, making it difficult if not impossible to properly install such bag therein.

In my U.S. Pat. No. 3,977,569 I have disclosed a drink dispenser attaining the advantages of both the traditional barrel-shaped shell formed by a pair of cup-shaped halves, each half having one closed and one open end, the halves being connectable to and separable from one another at their open ends about a plane perpendicular to the longitudinal axis of the shell. Cooperable locking means are formed on the halves adjacent their open ends for locking the halves together to form a closed outer shell in the shape of a barrel. A fluent filled flexible bag having a dispensing spout thereon is contained within the shell with the spout adjacent the closed end of one of the halves. The one half has an opening in its closed end adjacent the spout including integrally formed pivotal flaps which are movable to accommodate access to and removal of the spout through the opening, and which serve to secure the spout in the opening in dispensing position at the one end of the shell. In this manner, I have provided a very attractive, yet economical and practical, dispenser for wines and other beverages.

OBJECTS OF THE INVENTION

The principal object of the present invention is to provide a better, and even more practical and more economical fluent dispenser attaining the advantages of both traditional or aesthetically acceptable shape and design and the desirable characteristics of the filled dispensing bag.

Another object of the present invention is to provide a container of the foregoing type comprising an integral, preferably blow-molded plastic, barrel-shaped shell having one closed end and one open end, and readily securable and separable closure for the open end for facilitating insertion and retention of a fluent filled bag.

A further object of the present invention is to provide a container of the foregoing type having locking means for securing the end closure to the shell.

Yet another object of the present invention is to provide a container of the foregoing type which will not roll about when layed on its side.

Still another object of the present invention is to provide for the convenient chilling of the contents of the bag.

SUMMARY OF THE INVENTION

In accordance with the present invention, a fluent dispenser includes an outer shell having one closed end and one open end, the shell at its open end including means for detachable reception of an end closure. A fluent filled flexible plastic bag having a dispensing spout thereon may very easily be lowered into the shell with the spout adjacent the open end thereof. Then, a generally planar end closure is detachably mounted in the open end of the shell to confine the fluid filled bag therein.

The shell preferably is barrel-shaped and formed of an integral, semi-rigid, molded plastic member, and the closure is disc shaped and formed of fiberboard. The closure includes integrally formed pivotal flaps located in proximity to the spout, the flaps being movable to accommodate access to and removal of the spout through the disc, and to secure the spout to the disc in a fluent dispensing position at the open end of the shell.

In one embodiment, the spout is positioned adjacent the side wall of the shell at the open end thereof, and the shell is formed with a flattened or planar area along the outer side wall portion thereof which serves to orient the spout at the bottom of the disc and to prevent the barrel-shaped shell from rolling when the shell is placed on its side in fluent dispensing position. The flattened area can simulate the conventional filling bung or an ordinary barrel.

In another embodiment, the shell may be provided with a removable bung located opposite the flattened area and thus at the top surface of the barrel when the barrel is set on its side in drink dispensing position. The bung may thus be removed to accommodate insertion of ice cube and/or ice water into the barrel between the shell and the flexible bag to chill the contents of the bag.

In the latter embodiment, it is also preferable to provide an integral, partial end wall portion at the open end of the shell which will be oriented at the bottom when the barrel is placed on its side in drink position to prevent ice water or other chillant from leaking out of the barrel.

The above stated objects of the invention are thus attained with particular facility and economy. Other objects, advantages and features of the invention will become apparent from the following detailed description, when taken in conjunction with the accompanying drawings.

DETAILED DESCRIPTION

Figure 1:
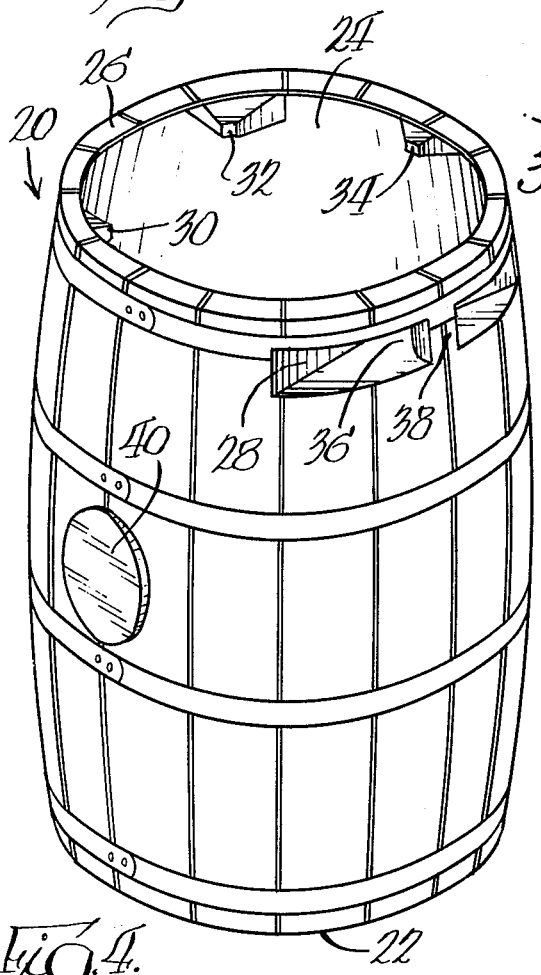
FIG. 1 is a perspective view of a blow-molded, barrel-shaped shell provided in accordance with the present invention.
Figure 2:
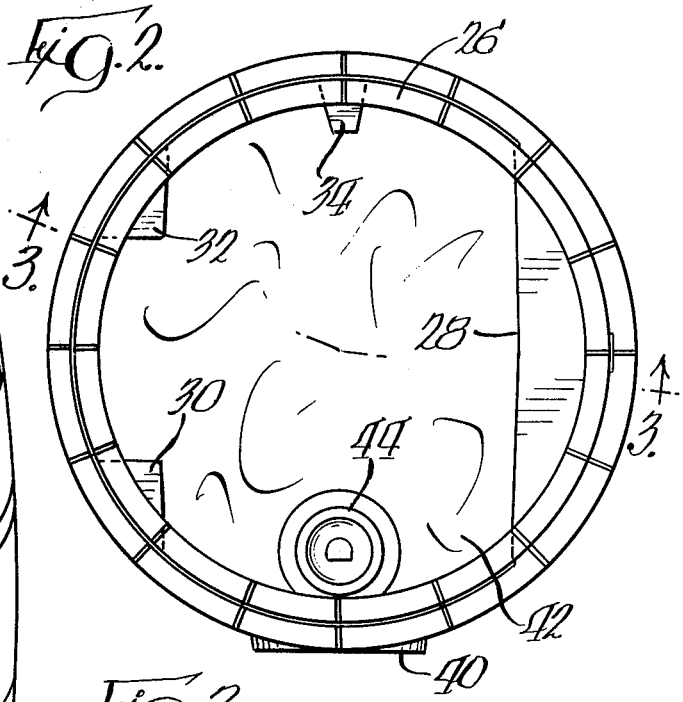
FIG. 2 is a plan view of the shell of FIG. 1, illustrating a fluid filled bag inserted therein.

Referring to the drawings, FIG. 1 illustrates an integral, blow molded, plastic container or shell 20 which, in accordance with a preferred embodiment of the invention, is in the form of a barrel. The shell is closed at one end 22 thereof by an integral imperforate wall and is open at its opposite end 24. The shell is molded with a barrel stave and hoop pattern, including a bung 40 and simulated wood grain on the outer surface thereof, to simulate as much as possible a conventional barrel. The shell preferably is formed of an economical polymer material which has sufficient rigidity to be shape-retentive and to support a fluent therein, but is resilient enough to resist breaking, such a material being polyethylene.

Figure 3:
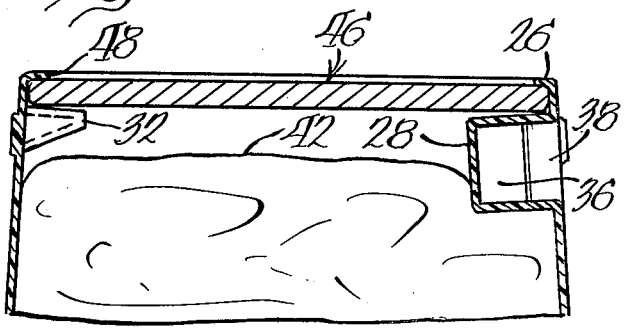
FIG. 3 is a fragmentary cross-sectional view taken substantially along the lines 3—3 of FIG. 2, showing an end closure inserted into and closing the open end of the shell.

The open end of the barrel terminates in a radially inwardly extending, transverse, yieldable, annular lip or flange 26 formed integrally with the side wall of the shell. Immediately to the interior of the flange, the barrel or shell includes a plurality of integrally molded, inwardly extending recessed sections 28, 30, 32 and 34 spaced circumferentially around the side wall of the shell. One of the sections 28 is relatively elongated to define a recessed area 36 of sufficient size to permit entry of a finger therein, and this area is bridged by a transverse bar 38 formed integral with the shell and comprising a finger gripping handle, whereby the barrel may readily be gripped and transported. The surfaces of the sections 28, 30, 32 and 34 facing toward the open end of the barrel are spaced from the opposed surface of the flange 26 by a distance approximately equal to the thickness of a sheet of corrugated fiberboard, and are preferably tapered in the direction toward the interior of the barrel as shown in FIG. 3. Also, the sections 28, 30, 32 and 34 preferably extend radially inwardly beyond the inner extremity of the flange 26.

By utilizing a split mold, split along the longitudinal, diametrical plane containing the center line of the finger grip or handle 38, the shell 20 is very readily and economically produced by conventional blow-molding techniques. In the alternative, the shell may also readily be produced by thermoforming, extrusion or injection molding techniques.

The shell 20 is adapted for reception therein of a flexible plastic bag 42 containing a liquid or fluent material, such for example as wine, spirits, or other beverages. The bag is made of a flexible polymer material, either single wall or multiply wall, as is known in the art. The bag has a spout 44 secured thereto and communicating with the interior thereof, through which a fluent may initially be introduced to fill the bag, and through which the fluent may later be dispensed from the bag. The bag and spout are positioned within the shell with the spout adjacent the open end thereof, and in the instant case with the spout adjacent a side wall portion of the shell including the bung 40. The bag may be filled either before or after insertion in the barrel. In either case, with the barrel positioned as illustrated in FIG. 1, the bag is very simply and expeditiously lowered into the barrel. For shipping and storage convenience, the bag and the spout are sealingly contained within the shell, but the spout may later be positioned to the exterior of the shell for dispensing the fluent from the bag, as will be described.

Referring to FIG. 3, to close the shell 20 and to retain the bag 42 within the shell, and to later support the spout in a drink dispensing position to the exterior of the shell, an end closure or wall conforming generally in shape to the open end 24 of the shell, and in the case of the barrel-shaped shell a circular disc, shown generally as 46, of a semi-rigid material such as corrugated fiberboard, is mounted in the open end of the shell. The disc is of a diameter approximately equal to the inner diameter of the shell adjacent the open end thereof, and is mounted in the open end and locked at its' periphery therewithin by being pressed past the inner edge 48 of the flange 26 and against the facing surfaces of the sections 28, 30, 32 and 34. During insertion of the disc, the flange 26 is yieldably urged outwardly to accommodate movement of the outer periphery of the disc therepast. Then, upon movement of the disc past the edge 48, the flange resiliently returns to its initial position to retain the disc between the flange and said surfaces, as shown in FIG. 3.

Figure 4:
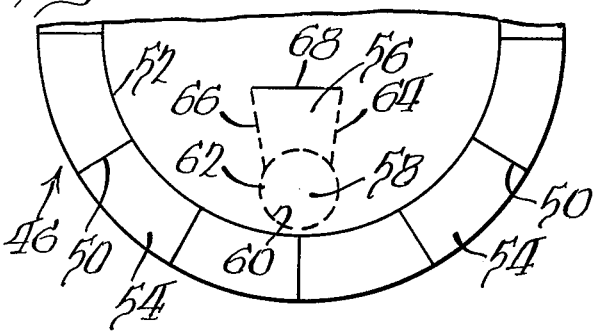
FIG. 4 is a fragmentary plan view of the disc, showing flaps formed therein for accommodating the dispensing spout of the bag, and radial slits for facilitating insertion of the disc into the open end of the shell.

Referring to FIG. 4, to facilitate movement of the disc 46 past the flange 26, a plurality of radially extending slits 50 are formed through the disc at spaced positions around the circumference thereof. The slits extend from the circumference of the disc to a circular score line or crease 52 formed in the disc inward from the periphery to define a plurality of integrally hinged, bendable tabs 54 around the outer periphery of the disc. Upon movement of the disc past the flange, the tabs bend upwardly and inwardly about the crease to slightly reduce the diameter of the disc to facilitate movement of the disc therepast. Then, when the tabs clear the flange, and the disc engage the radially extending inner portions of the sections 28, 30, 32 and 34, the tabs resiliently return to essentially their initial position, thereby to trap the circumferential portions of the disc between the flange and said sections and to enclose the fluent filled bag in the shell.

The disc 46 also has cut and score lines therein defining movable flaps, i.e., a hinged flap 56 and a removable plug 58, which together define an opening 60 for the fluid dispensing spout of the bag. The flap 56 is generally triangular in shape, and tapers downward to the plug 58 which is circular in shape. The plug 58 is separable from the disc along a circular interrupted slit or cut line 62. The flap 56 is defined by a pair of interrupted cuts or slits 64 and 66 and is pivotable with respect to the disc on an integrally formed hinge or score line 68. In position the disc within the open end of the shell, the plug and flap are oriented to be immediately adjacent the spout 44. Thus, by pressing in on the plug 58 to sever it from the disc, and by then removing the plug and pivoting the flap outward, access is gained to the spout.

Figure 5:
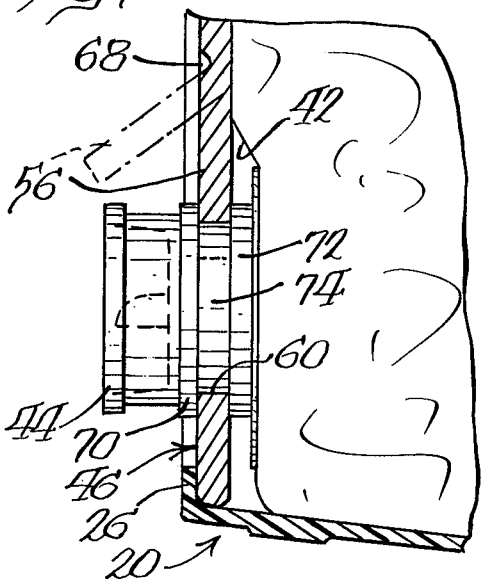
FIG. 5 is a fragmentary longitudinal section illustrating the spout extended through and secured within the disc.

Referring to FIG. 5, after purchasing a barrel of a beverage, for example wine, the consumer merely pushes in on and removes the lower circular flap 58, pulls the upper flap 56 outwardly about the hinge 68, and withdraws the tap or spout 44 from inside the shell. The spout normally is provided with a pair of spaced annular rings or collars 70 and 72 or other means which define an annular recess 74 therebetween for reception of the portion of the disc 46 surrounding the opening 60 formed upon removal of the plug 58. The flap 56 is then pivotally returned to its original position to engage in the recess 74 and thereby lock and hold the spout in fluid dispensing position. The barrel may then be placed on its side with the spout oriented at the bottom of the disc to facilitate convenient dispensing of the wine. Putting the barrel on its side, rather than standing it vertically, reduces the vertical space required to store the dispenser. The dispenser may be stored at room temperature or in a refrigerator. In either case, the barrel need not be removed from its place of storage for dispensing the beverage, as the beverage or spirit is available merely by operating the spigot.

Manifestly, the flap and plug 56 and 58 providing the spout opening could be provided in the opposite end wall of the barrel shell if desired. However, this is not preferred since it would necessitate performance of a separate, extra manufacturing step, make it more difficult to orient the spout adjacent the flaps, and reduce the potential for filling the bag directly in the shell.

To prevent the barrel-shaped shell 20 from rolling about when laid on its side, a support means is provided and/or a portion of the shell is formed of non-circular cross-section. The support means could, for example, comprise a pair of legs on the side of the shell on which the shell may be rested. Preferably, however, the support means is formed integral with and as a part of the barrel shape. In the present embodiment, the support is conveniently provided by the bung 40, which has a flat outer surface and is formed on the side wall portion of the shell which extends adjacent to the spout 44, whereby firmly to support the barrel in dispensing position without rolling. In any event, with the barrel laid on its side the support means preferably provides for tilting of the shell toward its open end to facilitate complete removal of the contents therein.

After the beverage in the bag 42 has been consumed, the disc 46 may be removed to open the shell and permit the empty bag to be removed and a full bag substituted therein. Alternatively, the shell may economically be discarded, or utilized as a bowl, flower pot, etc. as the purchaser may desire.

In the embodiment of the drink dispenser thus far described, the bung 40 is merely a simulation integrally molded with the barrel-shaped shell 20 and serving the functions of preventing the barrel from rolling and orienting the spout in dispensing position. In another embodiment of the invention, the shell is molded with a bung opening, and a bung is separately formed for removable but sealing insertion in the opening. In some circumstances and in certain environments, it may not be possible or desirable to store the drink dispenser in a refrigerator. In such event, if it is desired to serve the beverage chilled, ice cubes and/or ice water may be inserted through the bung opening into the shell and around the bag to keep the beverage cold.

Figure 6:
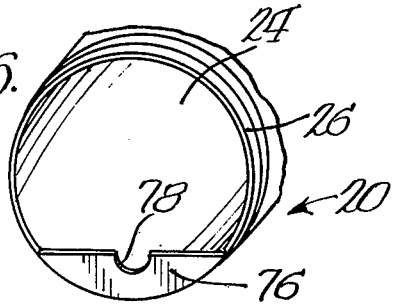
FIG. 6 is a fragmentary perspective view of the open end of a modified form of barrel-shaped shell including an integral barrier for supporting the spout of the flexible bag and for containing a cooling fluid within the shell and around the bag when the shell is positioned on its side.

In this case, as shown in FIG. 6, the barrel-shaped shell is preferably formed with an integral, transverse, fluid barrier wall 76 extending partially across the open end of the shell at the bottom thereof when the barrel is in dispensing position, whereby to confine and prevent leaking of melted ice from within the shell. The partial end wall 76 may contain slitted and scored portions defining a movable flap and a removable plug comparable to those in the disc 46 previously described, or may in the alternative be provided with a generally semi-circular opening 78 in the edge of the barrier for receiving and more firmly supporting the drink dispensing spout. Since the shell and the beverage bag are of plastic, the melted ice has no deleterious effect thereon, nor on the beverage within the bag.

If desired, the removable bung could remain at the bottom of the barrel in drink dispensing position to serve its orientation functions. Alternatively, the barrel could have a flat spot for orientation and support purposes and the bung opening could be provided opposite thereto, and thus at the top of the barrel, for convenient insertion of ice and/or ice water without leaking. Manifestly, warm water and other heat exchange mediums could also be used. Further, the disc may in this case be formed with a chorded section removed, corresponding to the transverse wall 76, whereby it if were made of a wettable material it would not extend into an area where it would be contacted by cooling water.

The drink dispenser of the present invention affords many advantages over prior dispensers, and in particular that of my prior U.S. Pat. No. 3,997,569. Principal among these are vastly improved economy, a greater convenience and simplicity of assembly and filling, improved stability and reliability during shipment, storage and use, and greater realism. In particular, since the shell or barrel 20 is an integral, unitary member, the same can be fabricated at very low cost, especially by blow-molding techniques. In fact, at least in the one gallon size, the barrel can be produced cheaper than the conventional fiberboard carton. Being of one piece, the shell is more rigid and better capable of retaining its shape and integrity than a multiple piece barrel or container. Consequently, the shell can be handled with far greater stability and reliability both in the filling and assembly operations and in shipping storage and use. Also being of one piece and open at one end, the shell greatly facilitates insertion of the flexible beverage bag into the shell, either before or after filling thereof, by simply lowering the bag into the shell; as contrasted with the difficulty of trying to assemble a two or more part container around a bag of liquid that has no more stability of shape than quicksilver. The assembly is completed simply by snapping or pressing a disc into the open end of the shell, as contrasted with the difficulty and questionable reliability of assembling two halves to one another. The use of the disc with the open ended shell greatly facilitates proper orientation of the bag and its spout within the shell, and proper orientation of the spout opening in the disc with both the shell and the bag spout. In addition to all of the foregoing, being of one piece and being closed at only one end by a removable disc, the shell has great realism in its simulation of a wooden barrel or wine cask. It is very pleasing aesthetically. And it provides all of the advantages of both the traditional barrel and the bag-in-box concept.

The wine or other beverage is not exposed to the air until it is dispensed, inasmuch as air does not enter the bag and the bag simply collapses as wine is extracted therefrom. Consequently, the wine can be purchased in fairly large and economical quantities, for example in one gallon or five gallon barrels, for consumption over a fairly long period of time without spoilage, whether stored at room temperature or in a refrigerator. Since both the bag and the shell are plastic, spillage will not damage the dispenser and the dispenser will retain its good looks and attractive appearance throughout its life cycle.

Thus, the objects and advantages of the invention have been shown to be attained in a facile manner of great economy.

While particular embodiments of the invention have been described in detail, it is to be understood that various modifications and other embodiments thereof may be made by one skilled in the art without departing from the spirit and the scope of the invention, as defined by the appended claims.

What is claimed is:

1. A fluent dispenser comprising an outer shell having an opening thereto; an inner flexible bag filled with fluent material inserted in said shell through said opening, said bag having a fluent dispensing spout thereon positioned in said shell adjacent said opening, and a generally planar closure for said opening, said shell having means formed integrally therewith for detachably mounting said closure in said opening to retain said bag and spout therein, said bag and spout normally being retained entirely within said shell and closure without fixed attachment thereto for safety and sanitation in shipment and handling, said closure having normally rigid but movable flaps accommodating access to and removal of said spout through said closure and mounting of said spout in fluent dispensing position.

2. A fluent dispenser as set forth in claim 1, said outer shell comprising a unitary, barrel-shaped, at least semi-rigid shell.

3. A fluent dispenser comprising an outer shell having an opening thereto and at least one inwardly extending flange at said opening and at least one inwardly projecting portion defining a surface opposed to said flange and spaced therefrom; an inner flexible bag filled with fluent material inserted in said shell through said opening, said bag having a fluent dispensing spout thereon produced in said shell adjacent said opening and a generally planar closure conforming generally in shape to said opening and being pressed past said flange and against said opposed surface and entering said spacing between said flange and said surface to detachably mount said closure in said opening and to retain said bag in said shell, said closure having normally rigid but movable flaps accommodating access to and removal of said spout through said closure and mounting of said spout in fluent dispensing position.

4. A fluent dispenser as set forth in claim 3, said closure having inwardly extending slits formed at spaced positions around the circumference thereof defining a plurality of resiliently bendable tabs around the circumference to facilitate movement of said disc past said flange and against said surfaces.

5. A fluent dispenser as set forth in claim 3, said movable flaps being formed integrally with said closure.

6. A barrel-shaped drink dispenser comprising a unitary, barrel shaped, at least semi-rigid outer shell, an end wall at one end of said shell closing said one end thereof, and a detachable end wall at the opposite end of said shell for selectively closing or opening said opposite end of said shell, said shell having means integrally formed therewith at said opposite end for detachably mounting said detachable end wall thereon; an inner flexible bag filled with fluent material and having a fluent dispensing spout therein, said bag and spout being separate from said detachable end wall; said bag, upon removal of said detachable end wall, being inserted into and outer shell through its open end with said spout located contiguous to one end wall and adjacent the side wall of said shell; said bag and spout, upon attachment of said detachable end wall, being confined within and retained by said shell and said end walls for safety and sanitation in shipment and handling; said one end wall contiguous to said spout including normally rigid but movable flaps located in proximity to said spout, said flaps being movable to accommodate access to and removal of said spout through said one end wall and to secure said spout in fluent dispensing position in said one end wall while said fluent filled bag is retained within said shell.

7. In a drink dispenser as set forth in claim 6, said shell including a side wall portion of noncircular cross-section aligned with said spout and said flaps for supporting said shell on its side without rolling and for orienting said spout downward at the bottom of said one end wall when said shell is placed on its side in drink dispensing position.

8. In a drink dispenser as set forth in claim 6, said shell having a bung opening in the side wall thereof, and including a bung removably insertable into said opening, said opening accommodating insertion of a heat exchange medium into said shell between said shell and said bag for thermally treating the contents of the bag without coming into contact with such contents.

9. A barrel-shaped drink dispenser comprising a unitary, barrel-shaped at least semi-rigid outer shell, an end wall at one end of said shell closing said one end thereof, and a detachable end wall at the opposite end of said shell for selectively closing or opening said opposite end of said shell; an inner flexible bag filled with fluent material and having a fluent dispensing spout thereon; said bag, upon removal of said detachable end wall, being inserted into said outer shell through its open end with said spout located contiguous to one end wall and adjacent the side wall of said shell; said bag, upon attachment of said detachable end wall, being confined within and retained by said shell and said end walls for safety in shipment and handling; said one end wall contiguous to said spout including normally rigid but movable flaps located in proximity to said spout, said flaps being movable to accommodate access to and removal of said spout through said one end wall and to secure said spout in fluent dispensing position in said one end wall while said fluent filled bag is retained within said shell; said shell having a side wall portion of noncircular cross-section comprising a bung formed on said shell and having a flat outer surface, said bung being aligned with said spout and said flaps for supporting said shell on its side without rolling and for orienting said spout downward at the bottom of said one end wall when said shell is placed on its side in drink dispensing position.

10. A barrel-shaped drink dispenser comprising a unitary, barrel-shaped, at least semi-rigid outer shell, an end wall at one end of said shell closing said one end thereof, and a detachable end wall at the opposite end of said shell for selectively closing or opening said opposite end of said shell; an inner flexible bag filled with fluent material and having a fluent dispensing spout thereon; said bag, upon removal of said detachable end wall, being inserted into said outer shell through its open end with said spout located contiguous to one end wall and adjacent the side wall of said shell; said bag, upon attachment of said detachable end wall, being confined within and retained by said shell and said ends walls for safety in shipment and handling; said one end wall contiguous to said spout including normally rigid but movable flaps located in proximity to said spout, said flaps being movable to accommodate access to and removal of said spout through said one end wall and to secure said spout in fluent dispensing position in said one end wall while said fluent filled bag is retained within said shell, said shell having a bung opening in the side wall thereof, and including a bung removably insertable into said opening, said opening accommodating insertion of a heat exchange medium into said shell between said shell and said bag for thermally treating the contents of the bag without coming into contact with such contents, said bung being located in a side wall portion of said shell which is aligned with said spout and said flaps, said bung having a flat outer surface for supporting said shell on its side, for preventing said shell from rolling, and for orienting said spout in drink dispensing position at the bottom of said one end wall.

11. In a barrel-shaped drink dispenser comprising a unitary, barrel-shaped, at least semi-rigid outer shell having one end closed by an end wall and the other end open; an inner flexible bag filled with fluent material inserted into said outer shell through said open end thereof; and a semi-rigid removable end wall for said open end of said shell, said shell having integral means for detachably mounting said removable end wall in said open end of said shell for safely retaining said fluent filled bag in said shell; said bag having a fluent dispensing spout thereon and being positioned in said shell with said spout contiguous to one end wall and adjacent the side wall of said shell, said one end wall including normally rigid but movable flaps located in proximity to said spout, said flaps being movable to accommodate access to and removal of said spout and to secure said spout in said one end wall in fluent dispensing position.

12. A barrel-shaped drink dispenser comprising a unitary, blow-molded, at least semi-rigid, plastic outer shell of barrel-shape and ornamentation having one closed end and one open end; a flexible plastic inner bag filled with fluent material and having a fluent dispensing spout thereon, said bag being inserted into said outer shell through said open end thereof with said spout adjacent the side wall of said shell at said open end; and a semi-rigid disc for closing said open end, said shell having means formed integrally therewith for mounting said disc in said open end, said disc being locked into and closing said open end of said shell, said disc including normally rigid but movable flaps oriented in proximity to said spout, said flaps being movable to accommodate access to and removal of said spout through said disc and to secure said spout in said disc in fluent dispensing position.

13. In a drink dispenser as set forth in claim 12, said shell including a side wall portion of noncircular cross-section aligned with said spout and said flaps for supporting said shell on its side and preventing said shell from rolling and for orienting said spout at the bottom of said disc in drink dispensing position when said shell is placed on its side.

14. In a drink dispenser as set forth in claim 12, said shell having a bung opening in the side wall thereof, and including a bung removably insertable into said opening, said opening accommodating insertion of a heat exchange medium into said shell between said shell and said bag for thermally treating the contents of the bag without contacting said contents.

15. A barrel-shaped drink dispenser comprising a unitary, blow-molded, at least semi-rigid, plastic outer shell of barrel-shape and ornamentation having one closed end and one open end; a flexible plastic inner bag filled with fluent material and having a fluent dispensing spout thereon, said bag being inserted into said outer shell through said open end thereof with said spout adjacent the side wall of said shell at said open end; and a semi-rigid disc locked into and closing said open end of said shell, said disc including normally rigid but movable flaps oriented in proximity to said spout, said flaps being movable to accommodate access to and removal of said spout through said disc and to secure said spout in said disc in fluent dispensing position, said shell at its open end including at least one inwardly extending flange and interiorly thereof at least one inwardly projecting portion defining a surface opposed to said flange and spaced therefrom by a distance approximately equal to the thickness of said disc, said disc being pressed past said flange and against said opposed surface to confine said disc at its periphery between said flange and said surface for closing the open end of said shell.

16. In a drink dispenser as set forth in claim 15, said disc having a plurality of spaced, radially extending slits between the circumference thereof and an integral circular hinge formed inward from said circumference, said slits and hinge defining a plurality of resiliently bendable tabs around the peripheral portion of said disc to facilitate movement of said disc past said flange and against said surfaces.

17. A barrel-shaped drink dispenser comprising a unitary, blow-molded, at least semi-rigid, plastic outer shell of barrel-shape and ornamentation having one closed end and one open end; a flexible plastic inner bag filled with fluent material and having a fluent dispensing spout thereon, said bag being inserted into said outer shell through said open end thereof with said spout adjacent the side wall of said shell at said open end; and a semi-rigid disc locked into and closing said open end of said shell, said disc including normally rigid but movable flaps oriented in proximity to said spout, said flaps being movable to accommodate access to and removal of said spout through said disc and to secure said spout in said disc in fluent dispensing position, said shell including a side wall portion of noncircular cross-section aligned with said spout and said flaps for supporting said shell on its side and preventing said shell from rolling and for orienting said spout at the bottom of said disc in drink dispensing position when said shell is placed on its side, said side wall portion of noncircular cross-section comprising a simulated bung formed integrally with said shell and having a flat outer surface.

18. A barrel-shaped drink dispenser comprising a unitary, blow-molded, at least semi-rigid, plastic outer shell of barrel-shape and ornamentation having one closed end and one open end; a flexible plastic inner bag filled with fluent material and having a fluent dispensing spout thereon, said bag being inserted into said outer shell through said open end thereof with said spout adjacent the side wall of said shell at said open end; and a semi-rigid disc locked into and closing said open end of said shell, said disc including normally rigid but movable flaps oriented in proximity to said spout, said flaps being movable to accommodate access to and removal of said spout through said disc and to secure said spout in said disc in fluent dispensing position, said shell having a bung opening in the side wall thereof, and including a bung removably insertable into said opening, said opening accommodating insertion of a heat exchange medium into said shell between said shell and said bag for thermally treating the contents of the bag without contacting said contents, said shell at its open end including an integral, transverse barrier wall extending across a portion of said open end contiguous to said spout for preventing leakage of heat exchange medium from said shell.

19. In a drink dispenser as set forth in claim 18, said barrier wall including means thereon adjacent said spout to aid in securing said spout in said fluent dispensing position.

20. A barrel-shaped drink dispenser comprising a unitary, blow-molded, at least semi-rigid, plastic outer shell of barrel-shape and ornamentation having one closed end and one open end; a flexible plastic inner bag filled with fluent material and having a fluent dispensing spout thereon, said bag being inserted into said outer shell through said open end thereof with said spout adjacent the side wall of said shell at said open end; and a semi-rigid disc locked into and closing said open end of said shell, said disc including normally rigid but movable flaps oriented in proximity to said spout, said flaps being movable to accommodate access to and removal of said spout through said disc and to secure said spout in said disc in fluent dispensing position, said shell having a recess in the side wall thereof and including an integral transverse bar extending across said recess and defining a handle for carrying said shell.

21. A barrel-shaped drink dispenser comprising a unitary, blow-molded, at least semi-rigid, plastic outer shell of barrel-shape and ornamentation having one closed end and one open end, said shell at its open end including at least one inwardly extending flange and interiorly thereof at least one inwardly projecting section defining a surface opposed to and spaced slightly from said flange; a flexible plastic inner bag filled with fluent material and having a fluent dispensing spout thereon, said bag being inserted into said outer shell through said open end thereof with said spout adjacent the side wall of said shell at said open end; and a semi-rigid disc snapped past said flange and against said opposed surface and retained at its periphery between said flange and said surface for closing said open end of said shell, said disc including integrally formed flaps oriented in proximity to said spout, said flaps being movable to accommodate access to and removal of said spout through said disc and to secure said spout in said disc in fluent dispensing position; said outer shell including a side wall portion of non-circular cross-section aligned with said spout and flaps for supporting said shell on its side, for preventing said shell from rolling and for orienting said spout downward in drink dispensing position when said shell is supported on its side.

* * * * *